US008853903B2

(12) United States Patent
Mori

(10) Patent No.: US 8,853,903 B2
(45) Date of Patent: Oct. 7, 2014

(54) LOW ALLOY STEEL MATERIAL FOR GENERATOR ROTOR SHAFTS

(75) Inventor: Takanobu Mori, Hitachi (JP)

(73) Assignee: Mitsubishi Hitachi Power Systems, Ltd., Kanagawa (JP)

( * ) Notice: Subject to any disclaimer, the term of this patent is extended or adjusted under 35 U.S.C. 154(b) by 655 days.

(21) Appl. No.: 12/559,628

(22) Filed: Sep. 15, 2009

(65) Prior Publication Data

US 2010/0072866 A1 Mar. 25, 2010

(30) Foreign Application Priority Data

Sep. 19, 2008 (JP) ..... 2008-240157

(51) Int. Cl.

| | |
|---|---|
| ***H02K 7/10*** | (2006.01) |
| ***C22C 38/42*** | (2006.01) |
| ***C22C 38/44*** | (2006.01) |
| ***C22C 38/46*** | (2006.01) |
| ***C22C 38/04*** | (2006.01) |
| ***C22C 38/02*** | (2006.01) |

(52) U.S. Cl.

CPC ..... *C22C 38/42* (2013.01); *C22C 38/44* (2013.01); *C22C 38/46* (2013.01); *C22C 38/04* (2013.01); *C22C 38/02* (2013.01)

USPC ..... 310/75 R; 420/91

(58) Field of Classification Search

USPC ..... 310/261.1; 148/639, 644, 654; 420/91, 420/100, 101

See application file for complete search history.

(56) References Cited

U.S. PATENT DOCUMENTS

| | | | | |
|---|---|---|---|---|
| 5,548,174 | A * | 8/1996 | Siga et al. | 310/216.121 |
| 5,611,873 | A | 3/1997 | Yamada et al. | |
| 6,099,797 | A * | 8/2000 | Bhagwat et al. | 420/91 |
| 6,569,269 | B1 * | 5/2003 | Fujita et al. | 148/639 |
| 2004/0250931 | A1 * | 12/2004 | Dilmore et al. | 148/633 |

FOREIGN PATENT DOCUMENTS

| | | | |
|---|---|---|---|
| CN | 1390973 | A | 1/2003 |
| EP | 0 849 434 | A2 | 6/1998 |
| EP | 1 123 984 | A2 | 8/2001 |
| JP | 47-25248 | B | 7/1972 |
| JP | 50-7530 | B | 3/1975 |
| JP | 2-145749 | A | 6/1990 |

OTHER PUBLICATIONS

ASTM Standard A469, 1987.

* cited by examiner

*Primary Examiner* — Tran Nguyen
*Assistant Examiner* — Leda Pham
(74) *Attorney, Agent, or Firm* — Mattingly & Malur, PC

(57) ABSTRACT

Disclosed is a low alloy steel material for generator rotor shafts, which has tensile strength of not less than 700 MPa at room temperature. Preferably the low alloy steel material consists of, by mass percent, 0.15 to 0.35% carbon, 0.01 to 0.10% Si, 0.10 to 0.50% Mn, 1.3 to 2.0% Ni, 2.1 to 3.0% Cr, 0.20 to 0.50% Mo, 0.15 to 0.35% Cu, 0.06 to 0.14% V, and the balance of Fe and unavoidable impurities.

7 Claims, 2 Drawing Sheets

LOW ALLOY STEEL MATERIAL FOR GENERATOR ROTOR SHAFTS

INCORPORATION BY REFERENCE

The present application claims priority from Japanese patent application Ser. No. 2008-240157 filed on Sep. 19, 2008, the content of which is hereby incorporated by reference into this application.

TECHNICAL FIELD

The present invention relates to a low alloy steel for generator rotor shafts, which has excellent magnetic properties.

BACKGROUND ART

There have been known materials for rotor shafts, on which a magnetic field winding is mounted, such steels as shown in JP-B-47-25248 and JP-B-50-7530. In particular, as a generator shaft material necessitating not lower than 700 MPa of tensile strength at room temperature, a steel containing not less than 3.0% nickel and not more than 2.0% chromium as disclosed in ASTM Standard A469 has generally been used.

BRIEF SUMMARY OF THE INVENTION

Conventionally, as a rotor shaft material for a comparatively large size generator driven by a gas turbine or a steam turbine, a low alloy steel containing not less than 3.0% nickel has been used. However, such low alloy steel for generator rotor shafts containing the above range of nickel is inferior in magnetic properties. As a result, the efficiency of the generator decreases. On the other hand, since nickel is an essential component for improving the low alloy steel in hardenability although deteriorating magnetic properties, it has been difficult to reduce the nickel amount.

Accordingly, an object of the present invention is to provide a low alloy steel for generator rotor shafts, which low alloy steel contains a lower amount of nickel than those in conventional low alloy steels, and has improved magnetic properties and realizable hardenability.

Another object of the present invention is to provide a low alloy steel for generator rotor shafts, which low alloy steel has not lower than 700 MPa of tensile strength at room temperature, not higher than 275 AT/m of magnetizing force at room temperature, and not higher than 7° C. of FAIT.

Under the above objects, there is provided a low alloy steel for generator rotor shafts, which low alloy steel contains a reduced amount of nickel, an increased amount of chromium, and additive copper.

Specifically the low alloy steel contains, by mass percent, a primary component of Fe, 1.3 to 2.0% Ni, 2.1 to 3.0% Cr, and 0.15 to 0.35% Cu.

More specifically the low alloy steel consists essentially of, by mass percent, 0.15 to 0.35% carbon, 0.01 to 0.10% Si, 0.10 to 0.50% Mn, 1.3 to 2.0% Ni, 2.1 to 3.0% Cr, 0.20 to 0.50% Mo, 0.15 to 0.35% Cu, 0.06 to 0.14% V, and the balance of Fe and unavoidable impurities.

Using a low alloy steel according to the invention for generator rotor shafts, it is possible to reduce a field current being allowed to pass in a coil of a generator rotor since the low alloy steel is excellent in magnetic properties, so that the loss of the generator decreases thereby enabling the generation efficiency to be improved.

DETAILED DESCRIPTION OF THE INVENTION

If the nickel amount of the low alloy steels for generator rotor shafts is reduced, their hardenability will be deteriorated. Thus, a low alloy steel containing not less than 3.0% nickel has been used. The present inventors made researches on the hardenability of low alloy steels, and found that in the case where the nickel amount of those is reduced to a specific range, they can have a quench effect equivalent to that of a low alloy steel containing not less than 3.0% nickel by adding proper amounts of chromium and copper. Further, the inventors found that by manufacturing a generator with use of a generator rotor shaft material of a thus obtained alloy in which the nickel amount is made lower than that of conventional materials, the magnetic properties of the generator are improved as compared with conventional generators thereby improving the generation efficiency.

Hereinbelow, there will be provided a description of functions of the additive elements in the alloy of rotor shafts and reasons why the composition ranges of the elements are preferred.

Carbon is an indispensable element in order to improve hardenability and strength of the generator rotor shaft material, so that the low alloy steel needs it in an amount of not less than 0.15%. However, if the carbon amount exceeds 0.35%, toughness of the generator rotor shaft material is deteriorated. Therefore, the carbon amount is set to be 0.15 to 0.35%, preferably 0.20 to 0.30%.

Silicon has a deoxidizing effect, so that it has been added to generator rotor shaft materials as an element for improving the cleanliness of thereof. In recent years, by virtue of the progress of steel manufacturing technique such as the carbon deoxidation method under vacuum, a sound generator rotor shaft material can be produced by melting without additive silicon. From the viewpoint of prevention of temper embrittlement, the silicon amount should be a lower level, that is, within the range of 0.01 to 0.10%.

Manganese is an indispensable element in order to improve hardenability and toughness of the generator rotor shaft material, so that the material needs it in an amount of not less than 0.10%. However, if the manganese amount exceeds 0.50%, there will occur temper embrittlement of the generator rotor shaft material. Therefore, the manganese amount is set to be 0.10 to 0.50%, preferably 0.20 to 0.45%.

Nickel is an indispensable element in order to improve the generator rotor shaft material in hardenability, toughness of a central section of the material, and magnetic properties, so that the material needs it in an amount of not less than 1.3%. However, if the nickel amount exceeds 2.0%, the magnetic properties of the generator rotor shaft material are deteriorated. Therefore, the nickel amount is set to be 1.3 to 2.0%, preferably 1.4 to 1.8%.

Chromium is an indispensable element in order to improve hardenability and strength, and toughness of the central section of the generator rotor shaft material, so that the material needs not less than 2.1% of chromium. However, if the nickel amount exceeds 3.0%, the generator rotor shaft material is deteriorated in strength. Therefore, the chromium amount is set to be 2.1 to 3.0%, preferably 2.3 to 2.8%.

Molybdenum is an indispensable element in order to improve the generator rotor shaft material in hardenability, and toughness of the central portion of the material, and to alleviate temper embrittlement, so that the material needs not less than 0.20% of molybdenum. However, if the molybdenum amount exceeds 0.50%, the generator rotor shaft material is deteriorated in magnetic properties. Therefore, the molybdenum amount is set to be 0.20 to 0.50%, preferably 0.30 to 0.40%.

Copper is an indispensable element in order to improve hardenability, and toughness of the central section of the generator rotor shaft material, so that the material needs not less than 0.15% of copper. However, if the copper amount exceeds 0.35%, the generator rotor shaft material is deteriorated in forgeability. Therefore, the copper amount is set to be 0.15 to 0.35%, preferably 0.20 to 0.30%.

Vanadium heightens yield stress of the generator rotor shaft material by forming carbide particles to cause fine crystal grains, so that the material needs not less than 0.06% of vanadium. However, if the vanadium amount exceeds 0.14%, the generator rotor shaft material is deteriorated in toughness. Therefore, the vanadium amount is set to be 0.06 to 0.14%, preferably 0.08 to 0.12%.

The unavoidable impurities may be Al, P, S, Sn, Sb, As, and so on. The Al amount should be a lower level because aluminum deteriorates the material in toughness. The Al amount is preferably not more than 0.012%. The sulfur amount should be a lower level because sulfur forms inclusion MnS to deteriorate the material in toughness. The sulfur amount is preferably not more than 0.015%. The amounts of P, Sn, Sb, As and so on should be lower because these elements are liable to generate temper embrittlement of the material. Preferably, the P amount is not more than 0.020%, the Sn amount is not more than 0.015%, the Sb amount is not more than 0.004%, and the As amount is not more than 0.015%.

The invention low alloy steel material for generator rotor shafts may be produced by the following process:

(1) A melt of the material prepared by means of an electric furnace, and thereafter the melt is refined by a vacuum degassing process, a carbon deoxidation process under vacuum or an electroslag remelting process;

(2) the thus produced melt is cast into a die to produce an ingot;

(3) the ingot is subjected to hot forging at a temperature of not lower than 1150° C., subsequent normalizing at a temperature of not lower than 840° C., and subsequent tempering at a temperature of not lower than 600° C. to make fine crystal grains; and (4) subsequently the thus obtained material is subjected to austenitizing at a temperature of 860 to 900° C., subsequent quenching, such as water cooling, water jet cooling or water spray cooling, and subsequent tempering at a temperature of 560 to 660° C. to adjust mechanical properties of the material.

Figure 1:
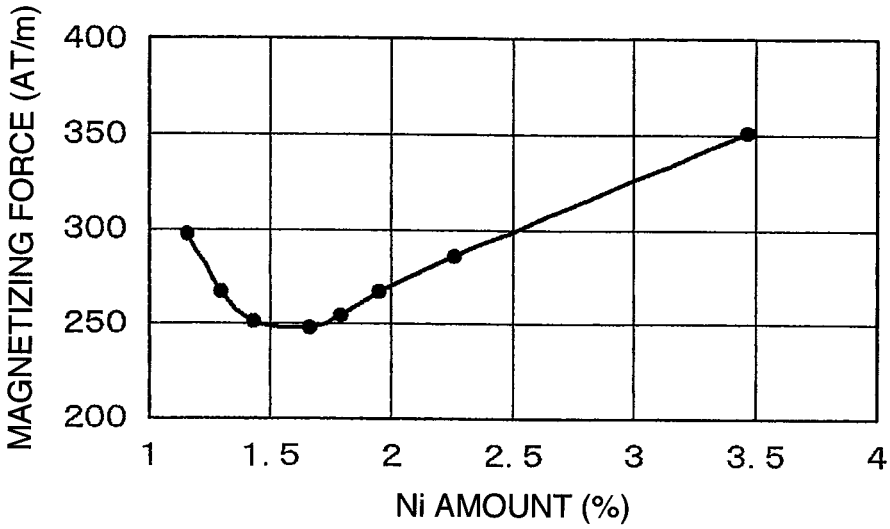
FIG. 1 is a graph showing the relationship between the nickel amount and the magnetizing force.

Other objects, features and advantages of the invention will become apparent from the following description of the embodiments of the invention taken in conjunction with the accompanying drawings.

Embodiments

Hereinbelow, there will be provided a description of embodiments of the invention low alloy steel material for generator rotor shafts. Table 1 shows the chemical compositions (mass %) of specimen steels. Specimen steel Nos. 3 to 7 and 9 to 14 are of embodiments of the present invention. Specimen steel Nos. 1, 2 and 8 are of comparative materials produced through melting for the purpose of comparison. Specimen No. 1 corresponds to Class 7 of ASTM Standard A469 concerning generator rotor shaft materials.

TABLE 1

| | Specimen Steel No. | Fe | C | Si | Mn | Ni | Cr | Mo | V | Cu | Al | P | S | Sn | Sb | As |
|---|---|---|---|---|---|---|---|---|---|---|---|---|---|---|---|---|
| Comparative material | 1 | Balance | 0.22 | 0.05 | 0.29 | 3.47 | 1.67 | 0.39 | 0.10 | 0.02 | 0.002 | 0.005 | 0.001 | 0.0025 | 0.0009 | 0.0030 |
| Comparative material | 2 | Balance | 0.27 | 0.04 | 0.26 | 1.16 | 3.12 | 0.36 | 0.09 | 0.20 | 0.005 | 0.007 | 0.004 | | | |
| Invention material | 3 | Balance | 0.28 | 0.07 | 0.27 | 1.30 | 2.64 | 0.37 | 0.10 | 0.21 | 0.004 | 0.011 | 0.003 | | | |
| Invention material | 4 | Balance | 0.30 | 0.03 | 0.26 | 1.43 | 2.62 | 0.38 | 0.11 | 0.25 | 0.005 | 0.014 | 0.004 | | | |
| Invention material | 5 | Balance | 0.26 | 0.03 | 0.29 | 1.67 | 2.56 | 0.35 | 0.10 | 0.27 | 0.006 | 0.013 | 0.007 | 0.0060 | 0.0012 | 0.0061 |
| Invention material | 6 | Balance | 0.24 | 0.04 | 0.28 | 1.79 | 2.52 | 0.34 | 0.12 | 0.26 | 0.003 | 0.021 | 0.006 | | | |
| Invention material | 7 | Balance | 0.26 | 0.01 | 0.27 | 1.98 | 2.50 | 0.36 | 0.11 | 0.28 | 0.004 | 0.009 | 0.005 | | | |
| Comparative material | 8 | Balance | 0.21 | 0.02 | 0.22 | 2.26 | 2.01 | 0.35 | 0.10 | 0.30 | 0.005 | 0.007 | 0.003 | | | |
| Invention material | 9 | Balance | 0.22 | 0.05 | 0.36 | 1.65 | 2.11 | 0.31 | 0.12 | 0.27 | 0.007 | 0.008 | 0.006 | | | |
| Invention material | 10 | Balance | 0.20 | 0.04 | 0.45 | 1.68 | 2.21 | 0.34 | 0.12 | 0.25 | 0.009 | 0.007 | 0.004 | | | |
| Invention material | 11 | Balance | 0.24 | 0.09 | 0.32 | 1.60 | 2.41 | 0.30 | 0.11 | 0.23 | 0.006 | 0.006 | 0.005 | 0.0036 | 0.0013 | 0.0083 |
| Invention material | 12 | Balance | 0.21 | 0.07 | 0.28 | 1.62 | 2.69 | 0.34 | 0.08 | 0.24 | 0.005 | 0.008 | 0.003 | | | |
| Invention material | 13 | Balance | 0.26 | 0.10 | 0.20 | 1.64 | 2.79 | 0.40 | 0.09 | 0.27 | 0.007 | 0.006 | 0.006 | | | |
| Invention material | 14 | Balance | 0.26 | 0.06 | 0.24 | 1.67 | 2.97 | 0.36 | 0.09 | 0.26 | 0.003 | 0.009 | 0.004 | | | |

Each of the specimen steels was prepared by the following process:

(1) A 20 kg ingot was produced by casting a melt of steel prepared by a melting furnace.

(2) The ingot was subjected to hot forging at a temperature of 1150 to 1250° C. to make a product having a thickness of 30 mm and a width of 90 mm.

(3) The product was subjected to a heat treatment simulating a cooling rate of a central section of a rotor shaft body in a large size generator, which heat treatment included normalizing at a temperature of 900° C., heating the work up to 880° C. for austenitizing, quenching the work from the temperature of 880° C. at a cooling rate of 200° C./hour, tempering at a temperature of 600 to 640° C. for 33 hours, and cooling to room temperature at a cooing rate of 30° C./hour in this order, wherein the tempering treatment was conducted by selecting a temperature such that obtained tensile strength of the work was within a range of not lower than 700 MPa for each specimen steel.

Each of the specimen steels subjected to the above heat treatment was subjected to a tensile test, a 2 mm V-notch Charpy impact test, and a DC magnetic property test. The tensile test was conducted at room temperature with use of a reduced size (5 mm diameter) No. 4 test piece of JIS Z 2201. The 2 mm V-notch Charpy impact test was conducted in a temperature range of −80 to +40° C. with use of a V-notch test piece of JIS Z 2202. The DC magnetic property test was conducted at room temperature with use of a test piece having a diameter of 200 mm and a length of 45 mm by the method specified in JIS C 2501 (a closed magnetic circuit is formed by an electromagnet and a test piece). The test results are shown in Table 2. FATT denotes a transition temperature through which there arises a transformation between a ductile fracture surface and a brittle fracture surface obtained by the impact test. The lower the value of FATT temperature, the higher the toughness of steel. In the DC magnetic property test, a magnetizing force was determined when a magnetic flux density reaches 21.2 kG (kilogauss). As the value of magnetizing force increases, the steel is excellent in magnetic property.

As will be appreciated from Table 2, the invention specimens, having preferable alloy compositions, have not lower than 700 MPa of tensile strength, not higher than 275 AT/m of a magnetizing force, and not higher than 7° C. of the FATT. Since generator rotor shafts rotate at 3000 to 3600 rpm, and repeats start and stop everyday, especially a slot section must be designed so as to withstand tensile stress incurred by a rotation centrifugal force. If the tensile stress exceeds the 0.02% proof stress in the slot section of a generator rotor shaft, there will arise problems such that plastic deformation is liable to occur, and fatigue fracture is liable to occur due to repeating stress fluctuation. Also, in the case where the values of elongation and reduction of area are low, the fracture toughness is low, and the fatigue fracture is liable to occur.

Figure 2:
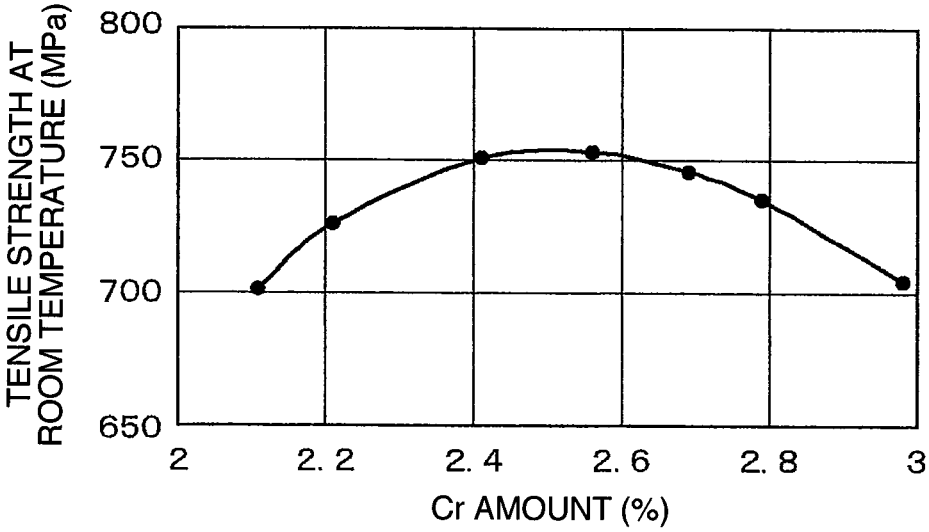
FIG. 2 is a graph showing the relationship between the chromium amount and the tensile strength.

FIG. 1 shows an influence of nickel amount on the magnetizing force when the magnetic flux density reaches 21.2 kG. As shown in FIG. 1, the magnetizing force is low when the nickel amount is in the range of 1.3 to 2.0%. Therefore, the nickel amount should be in the range of 1.3 to 2.0%. FIG. 2 shows an influence of chromium amount on tensile strength at room temperature. As shown in FIG. 2, not lower than 700 MPa of tensile strength at room temperature is attained when the chromium amount is in the range of 2.1 to 3.0%. Therefore, the chromium amount should be in the range of 2.1 to 3.0%. As shown in Table 2, the invention specimen steels have not higher than 7° C. of FATT, so that the toughness of the central section is also excellent.

Figure 3:
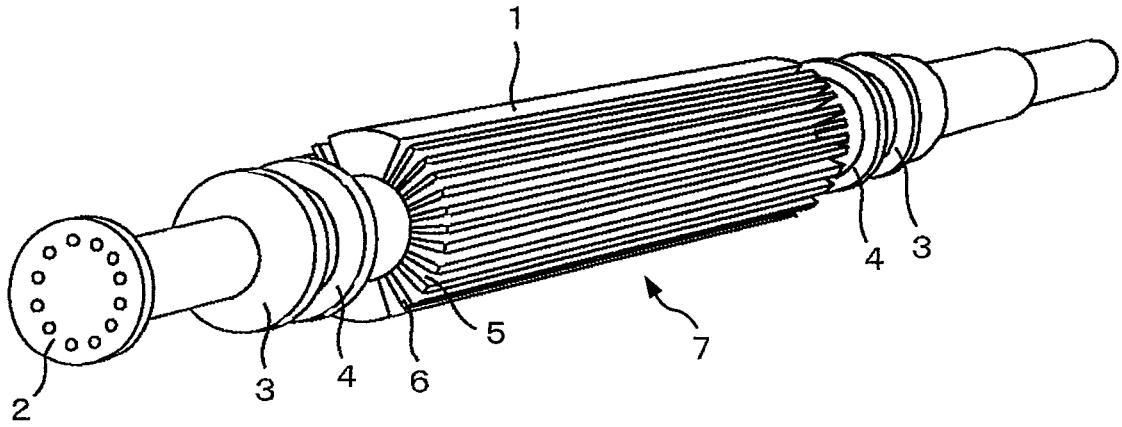
FIG. 3 shows a generator rotor shaft as one embodiment of the present invention.

FIG. 3 is a perspective view showing one example of a generator rotor shaft. The rotor shaft shown in FIG. 3 has a magnetic pole 1, a coupling 2, fan mounting rings 3, centering rings 4, slots 5, and teeth 6. The invention material is most suitably applied to the magnetic pole 1, the coupling 2, and the teeth 6, for example.

Figure 4:
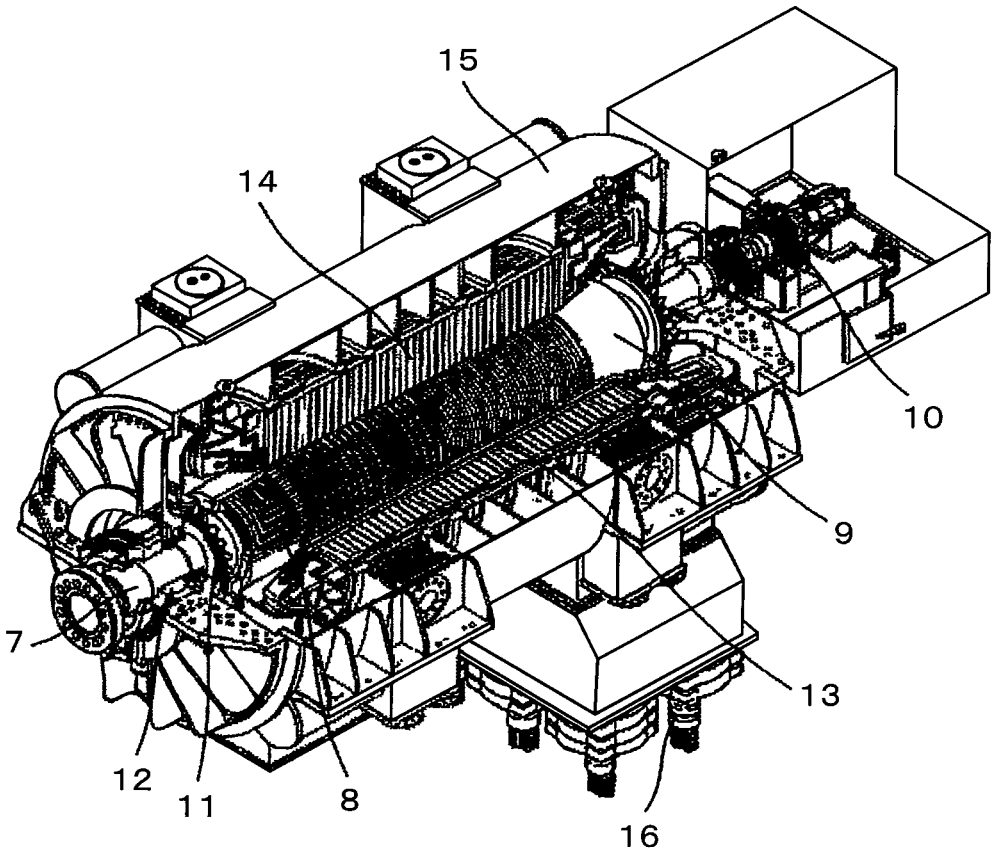
FIG. 4 is a general view of a generator which includes a generator rotor shaft with use of the invention material.

FIG. 4 is a general view of a generator. The whole of the generator shown in FIG. 4 has a generator rotor shaft 7, a rotor coil 8, a retaining ring 9, a collector ring brush 10, a fan 11, a

TABLE 2

| | Specimen Steel No. | Tensile strength (MPa) | 0.02% proof stress (MPa) | Elongation (%) | Reduction of area (%) | FATT (° C.) | Magnetizing force (AT/cm) |
|---|---|---|---|---|---|---|---|
| Comparative material | 1 | 879 | 716 | 21 | 64 | −20 | 351 |
| Comparative material | 2 | 745 | 588 | 23 | 61 | 10 | 297 |
| Invention material | 3 | 748 | 590 | 22 | 63 | 4 | 267 |
| Invention material | 4 | 750 | 592 | 24 | 62 | −1 | 251 |
| Invention material | 5 | 753 | 595 | 23 | 65 | −5 | 248 |
| Invention material | 6 | 755 | 596 | 23 | 63 | −8 | 254 |
| Invention material | 7 | 757 | 598 | 22 | 62 | −12 | 267 |
| Comparative material | 8 | 761 | 600 | 23 | 64 | −15 | 286 |
| Invention material | 9 | 701 | 554 | 22 | 61 | 12 | 247 |
| Invention material | 10 | 726 | 574 | 21 | 63 | 7 | 245 |
| Invention material | 11 | 751 | 593 | 22 | 60 | −3 | 249 |
| Invention material | 12 | 746 | 589 | 23 | 64 | −17 | 247 |
| Invention material | 13 | 735 | 581 | 21 | 63 | −22 | 246 |
| Invention material | 14 | 704 | 556 | 22 | 62 | −32 | 248 |

bearing 12, a stator coil 13, an iron core 14, a stator frame 15, and a high-voltage bushing 16.

It should be further understood by those skilled in the art that although the foregoing description has been made on embodiments of the invention, the invention is not limited thereto and various changes and modifications may be made without departing from the spirit of the invention and the scope of the appended claims.

The invention low alloy steel for generator rotor shafts is used as a generator rotor shaft material which is driven by a gas turbine or a steam turbine. In particular, it is used as a rotor shaft material having a tensile strength not lower than 700 MPa at room temperature.

DESCRIPTION OF REFERENCE NUMERALS

1 . . . a magnetic pole
2 . . . a coupling
3 . . . fan mounting rings
4 . . . centering rings
5 . . . slots
6 . . . tooth
7 . . . a generator rotor shaft
8 . . . a rotor coil
9 . . . a retaining ring
10 . . . a collector ring brush
11 . . . a fan
12 . . . a bearing
13 . . . a stator coil
14 . . . an iron core
15 . . . a stator frame
16 . . . a high-voltage bushing

The invention claimed is:

1. A low alloy steel for generator rotor shafts, consisting essentially of, by mass percent, 0.15 to 0.35% carbon, 0.01 to 0.10% Si, 0.10 to 0.50% Mn, 1.3 to 2.0% Ni, 2.1 to 3.0% Cr, 0.20 to 0.50% Mo, 0.20 to 0.30% Cu, 0.06 to 0.14% V, an absence of tungsten, and the balance of Fe and unavoidable impurities, wherein the low alloy steel has not higher than 275 AT/m of magnetizing force and wherein the low alloy steel has a FATT of not higher than 7° C.

2. The low alloy steel according to claim 1, which has tensile strength of not less than 700 MPa at room temperature.

3. A generator having a rotor shaft made of the low alloy steel as defined in claim 1.

4. A low alloy steel for generator rotor shafts, consisting essentially of, by mass percent, 0.15 to 0.35% carbon, 0.01 to 0.10% Si, 0.10 to 0.50% Mn, 1.5 to 1.8% Ni, 2.1 to 3.0% Cr, 0.20 to 0.50% Mo, 0.15 to 0.35% Cu, 0.06 to 0.14% V. an absence of tungsten, and the balance of Fe and unavoidable impurities, wherein the low alloy steel has not higher than 275 AT/m of magnetizing force and wherein the low alloy steel has a FATT of not higher than 7° C.

5. The low alloy steel according to claim 4 which contains 2.30 to 2.80% Cr.

6. The low alloy steel according to claim 5 which contains 0.20 to 0.30% Cu.

7. The low alloy steel according to claim 5 which contains 0.30 to 0.40% Mo.

* * * * *